United States Patent [19]

Burmeister

[11] Patent Number: 4,556,097

[45] Date of Patent: Dec. 3, 1985

[54] MOLD PLUG AND METHOD FOR SEALING AN INGOT MOLD

[75] Inventor: Kevin L. Burmeister, Kent, Ohio

[73] Assignee: Graphite Sales, Inc., Chagrin Falls, Ohio

[21] Appl. No.: 625,085

[22] Filed: Jun. 27, 1984

[51] Int. Cl.[4] ..... B22D 7/06; B22D 7/12

[52] U.S. Cl. ..... 164/137; 164/342; 164/DIG. 6; 249/204; 222/597

[58] Field of Search ..... 164/137, 342, 339, DIG. 6, 164/7.2, 160.2, 23, 27, 33; 249/204; 266/271, 272, 45; 222/597, 563

[56] References Cited

U.S. PATENT DOCUMENTS 3,938,791 2/1976 Imberti ..... 266/272

*Primary Examiner*—Nicholas P. Godici
*Assistant Examiner*—Samuel M. Heinrich
*Attorney, Agent, or Firm*—Body, Vickers & Daniels

[57] ABSTRACT

A plug for closing the opening in the bottom of a top pouring ingot mold is comprised of a preformed plug body having top and bottom ends and an outer peripheral surface providing a contour generally corresponding with that of the mold opening to be plugged. The lower portion of the outer peripheral surface is provided with a coating of a thermally curable sealing composition having a heavy paste-like consistency, and the plug body and coating are enclosed in a heat shrinkable plastic film. In use, the plug is pushed into a plug opening in the bottom of an ingot mold which generally is hot from a previous casting operation, the plastic film disintegrates, the sealing material is squeezed so as to spread and fill the space between the mold opening and plug body, and the heat of the mold cures the sealing material to secure the plug in place and seal the peripheral space between the plug body and mold opening.

31 Claims, 3 Drawing Figures

MOLD PLUG AND METHOD FOR SEALING AN INGOT MOLD

BACKGROUND OF THE INVENTION

The present invention relates to the art of molds for forming ingots from molten metal and, more particularly, to an improved mold plug, method of making a mold plug, and method for plugging and sealing the opening in the bottom of a top pouring ingot mold.

Top pouring, bottom plugged ingot molds are well known in the art of metal casting and are characterized by having an opening through the bottom wall thereof which is closed by a removable plug prior to the pouring of molten metal into the top of the mold to form an ingot. Follow:ing the casting operation, the plug is destructible to facilitate removal or stripping of the ingot from the mold by impacting a tool against the bottom of the ingot through the opening in the bottom wall of the mold.

Plugs for such ingot molds are most often molded or otherwise formed from ceramic, refractory or carbon materials, or combinations thereof, and are of inverted frusto-conical configuration to provide top and bottom ends and an outer peripheral surface corresponding generally in contour with that of the plug opening in the bottom of the ingot mold. The surface on the bottom wall of a mold about the plug opening and the surface of the plug opening through the bottom wall are generally clean and smooth when the mold is new or relatively new and, unless damaged prior to use or during insertion of the plug into the mold opening, the outer peripheral surface of the preformed plug is also generally smooth. Under such conditions, the preformed plugs are suitable for closing the plug opening so as to minimize leakage of molten metal from the mold during an ingot casting operation and, generally, satisfactorily provide their intended function. However, the bottom surface of the mold and the surface of the mold opening become irregular with repeated use of the mold, and such irregularity is progressive in nature. Irregularities are caused in part, for example, by erosion due to metal leakage, and by the cutting away by an oxygen torch of metal which becomes welded to the surface of the mold opening as a result of leakage. As a result of these irregularities, gaps exist between the mold opening and plug when the latter is introduced into the plug opening prior to a casting operation. Such gaps provide leakage paths for molten metal subsequently poured into the mold, and leakage is undesirable from the standpoint of lost metal, time lost in connection with maintenance requirements resulting from leakage, and the danger of potential injury to workmen exposed to the molten metal. When leakage becomes excessive, replacement of the mold becomes necessary. Such replacement is expensive and often occurs when the mold is otherwise still usable. Efforts heretofore to prolong the use of a leaking mold and to defer mold replacement have included the procedure of initially pouring a small amount of molten metal into the bottom of the mold and allowing it to fill the leakage paths and solidify to close the leakage paths prior to pouring the remainder of the molten metal into the mold to complete the casting operation. It will be appreciated that this procedure is undesirable from the standpoint of being time consuming and, moreover, does not overcome the disadvantage of lost metal through leakage. Moreover, this procedure can leave metal welded to the opening and which must be cut away as explained above, causing further deterioration and thus further reducing mold life.

Further problems encountered in connection with the use of bottom plugged top pouring ingot molds include the thermal welding of molten metal to the wall of the ingot mold itself. Such welding, upon removal of the cast ingot, causes side wall erosion in the mold, thus reducing mold life. Further, if such erosion becomes severe, the ingot can become lodged in the mold to the extent that it cannot be removed therefrom, whereby both the ingot and the mold have to be scrapped. This is of course expensive both from the standpoint of lost metal and mold replacement. Another problem, which is essentially independent of the condition of the opening in the bottom wall of the ingot mold, is that the mold plug often is not sufficiently lodged or secured in the plug opening whereby, upon pouring molten metal into the ingot mold, the plug floats to the top of the metal bath because of the difference in specific gravity between the molten metal and plug material. It will be appreciated that this problem results in a total loss of metal from the ingot mold, erosion of the bottom opening by the flow of molten metal therethrough, the thermal welding of metal to the surface of the opening, the destruction of equipment supporting the mold, such as a railway car and tracks therebeneath, and the potential injury to workmen near the mold and having no warning with respect to such release of molten metal. While such a floating plug problem may only be occasional in occurrence, it will be appreciated that it is potentially the most serious and dangerous problem from the standpoint of equipment deterioration and loss, and personal injury.

SUMMARY OF THE INVENTION

In accordance with one aspect of the present invention, the bottom opening in a top pouring ingot mold is adapted to be closed and sealed against the leakage of molten metal across the opening through the use of a preformed mold plug and a coating of viscous thermosetting sealing material on the plug. More particularly, a preformed mold plug of the character described hereinabove is provided on the outer peripheral surface thereof with a coating of heat curable sealing material which, when the plug is pressed into the mold opening, is squeezed between the mold opening and plug surfaces to fill the peripheral space therebetween, including any spaces or gaps caused by surface irregularities in or about the mold opening. The sealing material is then cured in situ to seal and secure the plug in place. If the mold is hot from a previous casting operation, curing takes place as a result of the heat of the mold. However, the coated plug can be introduced into a cold mold following by flowing of molten metal into the mold, whereby curing of the composition results from the composition, plug and mold being heated by the molten metal. The sealing composition, when applied to the mold plug, is in the form of a heavy paste which, preferably, is only applied to about the lower half of the outer peripheral surface of the plug and is spread upwardly through the squeezing action which takes place upon pressing the plug into the mold opening.

In accordance with another aspect of the invention, a preformed mold plug coated in the foregoing manner is enclosed in a plastic film to facilitate handling and storage of the plug prior to use. More particularly in this respect, the plastic film seals the coated plug to maintain the sealing composition in its viscous state and to retain the sealing composition on the outer peripheral surface of the plug. The plastic film is preferably heat shrinkable and is heat shrunk on the plug so as to conform to the contour of the plug and the coating of sealing material thereon. The plastic film is physically destructible and heat degradable, whereby the film is ruptured to release the sealing composition for spreading when the enclosed plug is pressed into the opening of a cold mold and is consumed when the enclosed plug is pressed into the opening of a mold which is still hot from a previous casting operation. The plastic film in the first instance is then consumed when the mold is heated such as by pouring molten metal thereinto.

The sealing material composition is comprised of a finely ground aggregate and a thermosetting resinous binder in proportions providing for the uncured composition to have a thick paste texture. The aggregate can be a material or combination of materials of the character used to make preformed mold plugs such as ceramic, refractory and carbon materials or combinations thereof. While any suitable thermosetting binder could be used, including non-resinous binders such as lignin sulfonate and sodium silicate, water-free thermosetting resinous binders are preferred in that they enable minimizing moisture content in the sealing composition thus to avoid the potenetial danger of explosion through water and steam expansion in the sealing material. In a preferred embodiment of sealing material in accordance with the present invention, the resinous binder is provided by a mixture of two water-free thermosetting resinous binders each having a different temperature at which polymerization of the corresponding resin commences. Such a combination of waterfree binders provides a broad operating temperature range which enables use of the sealing composition substantially independent of mold temperature and, as more fully set forth hereinafter, provides controlled curing of the sealing material to optimize the strength of the sealing and securing of the plug body in the mold opening.

Importantly in accordance with the present invention, the sealing composition advantageously enables reducing the number of ingots which stick in the mold following a casting operation and as a result of thermal welding. In this respect, volatiles in the resinous binder, and possibly in the aggregate depending on the composition thereof, produce a gas barrier in the mold during the pouring of molten metal thereinto and curing of the sealing material. This gas barrier is set up between the molten metal and the bottom and side wall surfaces of the mold and operates to retard thermal welding of the molten metal to the mold. This advantageously reduces erosion of the mold walls caused by thermal welding and thus promotes increased mold life while minimizing loss of metal and molds which have to be scrapped when an ingot will not release from the mold. Of considerable importance also is the fact that the sealing composition, upon curing with the mold plug in place in the mold opening, not only seals against leakage of molten metal through the mold opening but also secures the plug in the opening against displacement therefrom during the pouring of molten metal into the mold. This advantageously eliminates the problem referred to hereinabove with respect to displacement of plugs from the mold opening and floating of the plugs to the top of the molten metal while the latter is being poured and, accordingly, overcomes the attendant loss of molten metal, damage and destruction of equipment, and the danger of injury to personnel.

It will be appreciated that the closing and sealing of an ingot mold opening in accordance with the present invention avoids metal loss by leakage during casting and avoids the maintenance time and problems attendant to such leakage. Moreover, the usable life of molds is extended, not only by being able to use molds wherein leakage would otherwise preclude further use but also by retarding the initiation of surface degeneration in new molds and retarding the progressive deterioration of the surfaces. Moreover, these advantages are achieved with a mold plug and procedure which are economical and efficient.

It is accordingly an outstanding object of the present invention to provide an improved method of plugging the opening in the bottom of a top pouring ingot mold using a preformed mold plug and which method provides for securing and sealing the preformed plug in the plug opening to avoid leakage of molten metal between the plug and opening during a casting operation and to avoid displacement of the plug from the opening during a casting operation.

Another object is the provision of a method of plugging and sealing the opening in the bottom of a top pouring ingot mold to reduce thermal welding of molten metal to the mold surfaces, thus prolonging the useful life of the mold and reducing the loss of ingots and molds resulting from such thermal welding.

A further object is the provision of an improved mold plug for closing and sealing the opening in the bottom of a top pouring ingot mold to avoid both plug displacement from the opening and leakage of molten metal between the plug and opening during a casting operation.

Still a further object is the provision of a mold plug of the foregoing character which enables reducing thermal welding of molten metal to the mold surfaces and erosion of mold surfaces, thus to prolong the useful life of ingot molds and reduce ingot and mold losses.

Yet a further object is the provision of a mold plug of the foregoing character which is comprised of a preformed plug body provided with a coating of thermosetting sealing material and a plastic film enclosure facilitating handling and storage of the plug prior to use.

Still another object is the provision of a mold plug comprising a preformed plug body and a coating of thermosetting sealing material, which coated plug enables the closing and sealing of the opening in an ingot mold which is either at ambient temperature or is still hot from a previous casting operation, and the immediate pouring of molten metal into the mold to secure the plug in the opening and seal against the leakage of molten metal through the opening.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
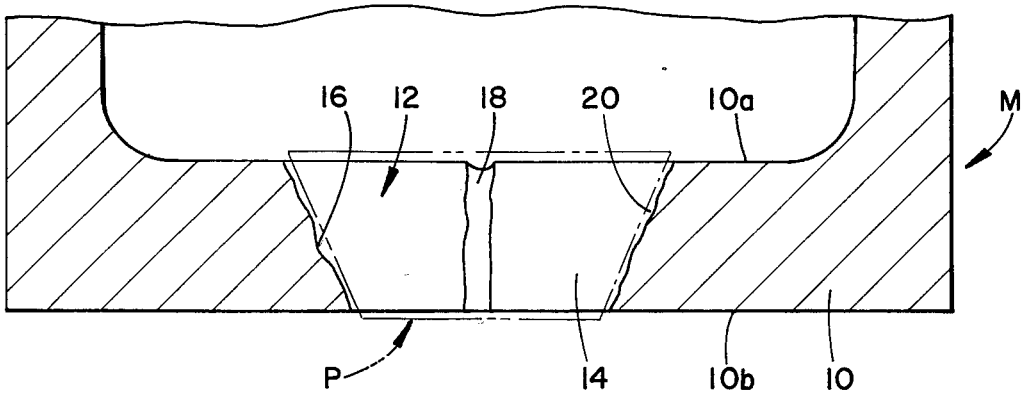
FIG. 1 is a cross-sectional elevation view showing the bottom portion of a top pouring ingot mold having surface irregularities in and about the opening through the bottom wall of the mold.

Referring now in greater detail to the drawings wherein the showings are for the purpose of illustrating a preferred embodiment of the invention only and not for the purpose of limiting the invention, FIG. 1 illustrates the lower portion of an ingot mold M and which bottom portion includes a bottom wall 10 having inner and outer sides 10*a* and 10*b*, respectively. Bottom wall 10 includes an opening 12 between inner side 10*a* and outer side 10*b* and which opening is of inverted frusto-conical configuration providing a peripheral wall 14 converging in the direction from inner side 10*a* toward outer side 10*b*. As a result of repeated use of the mold in the casting of metal ingots, the originally smooth contour of the surface of wall 14 and portions of inner side 10*a* surrounding opening 12 become irregular. For purposes of example only, such irregularities are shown in FIG. 1 in the form of recesses 16, 18 and 20 in wall 14 of opening 12 and extending throughout the length of the opening between inner side 10*a* and outer side 10*b*. Recesses such as those depicted in FIG. 1 are caused for example by surface erosion and, while not shown, it will be appreciated that surface irregularities can be and in practice are defined other than by such recesses alone. For example, surface irregularities can be in the form of raised projections on the surface of wall 14 resulting from metal build-up thereon. In any event, as will be appreciated from the broken line representation of a preformed mold plug P in FIG. 1, such surface irregularities provide spaces or gaps between wall 14 and the plug which define leakage paths across opening 12, whereby the pouring of molten metal into the mold during a casting operation results in leakage of molten metal from the mold.

Figure 2:
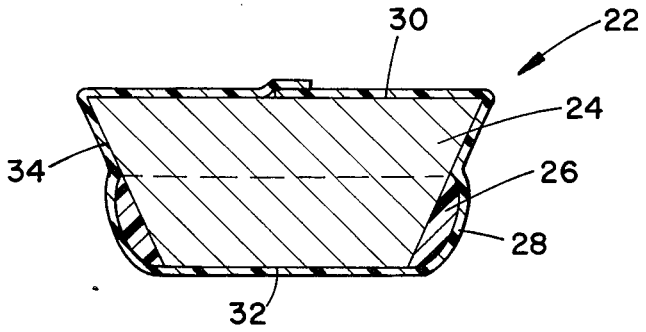
FIG. 2 is a cross-sectional elevation view of a mold plug according to the present invention; and, FIG. 3 is a cross-sectional elevation view showing the plug in FIG. 2 in place in the bottom opening of the mold in FIG. 1 to close and seal the opening.

In accordance with the present invention, a mold plug for plugging and sealing the bottom opening in a top pouring ingot mold is comprised of a preformed mold plug providing a plug body, and a coating of thermosetting sealing material which, upon pressing the mold plug into the mold opening, fills the spaces, recesses or gaps resulting from surface irregularities in the mold opening. Accordingly, potential molten metal leakage paths are closed and sealed to prevent leakage of molten metal from the mold upon the pouring of the molten metal thereinto. Advantageously in accordance with a preferred embodiment, a preformed mold plug coated with a thermosetting sealing composition is enclosed in a thin plastic film which facilitates handling and storage of the plug prior to its use and retention of the sealing composition in its viscous state and in place on the plug during such handling and storage. More particularly, as will be appreciated from FIG. 2 of the drawing, a mold plug 22 according to the present invention is comprised of a preformed plug body 24, a coating of a heat curable sealing composition 26 and an envelope or enclosure 28 of thin plastic film material. It will be appreciated that preformed plug 24 is of inverted frusto-conical configuration having top and bottom ends 30 and 32, respectively, and an outer peripheral surface 34 converging in the direction between ends 30 and 32. Thermosetting sealing composition 26 is comprised of a finely ground aggregate of ceramic, refractory or carbon material, or combinations thereof, and a thermosetting binder mixed with the aggregate in porportions of aggregate and binder which provide for the composition to have a texture of a spreadable heavy paste. In this respect, for example, the composition when applied to the preformed plug will adhere thereto and can be spread relative thereto, but will not freely flow therefrom. Preferably, sealing composition 26 is only provided on the lower half of peripheral surface 34 of plug body 24, and the aggregate therein has a screen size of about 80×0. Further, the coating preferably has a thickness laterally outwardly of surface 34 of from about 0.250 inch to 0.375 inch. This together with the fineness of the aggregate provides for the sealing composition to be readily squeezed and thus spread upwardly along the upper half of plug body 24 so as to fill the irregularities in the bottom opening of the mold upon insertion of the plug 22 into the mold opening and with the use of a minimum amount of the composition.

Plastic film 28 is preferably a shrink wrap film which, as is well known, is shrinkable upon being subJected to low temperature heat for a short period of time. The use of a shrink wrap film enables plug body 24 and sealing composition 26 to be enclosed in an envelope conforming to the contour of the coating and adjacent surface portions of the plug body. The plastic film enclosure advantageously enables the preparation, handling and storage of plugs 22 prior to use, and the retention of sealing composition 26 on peripheral surface 34 of the plug body. Moreover, the use of a heat shrinkable plastic film advantageously promotes retention of coating 26 in its applied location on surface 34 during handling and storage. A suitable plastic shrink wrap film for these purposes is a plastic film having a thickness of about 0.001 inch available from Reynolds Metals Company of Richmond, Virginia under the latter's product designation REYNOLNO.

Coating 26 can be applied in any suitable manner such as by brushing the composition onto surface 34, or dipping the lower end of the plug body into a receptacle containing the composition and scrapping the excess composition from the bottom of the plug. Likewise, plastic film 28 can be applied in any suitable manner to the coated plug body. As an example, plug 22 is quickly and economically produced by dipping the lower end of plug body 24 into a receptacle containing composition 26 and then scrapping the excess composition from bottom surface 34 of the plug body. The plug body is then placed on a sheet of plastic film material, the sheet is folded upwardly and across the top of the plug body and open areas of the wrap are sealed such as through the use of a heated wand. The plastic film is then shrunk and, in connection with the preferred film mentioned hereinabove, such shrinking is achieved by heating the enclosed coated plug body at a temperature of about 350° F. for a period of about five seconds.

Figure 3:
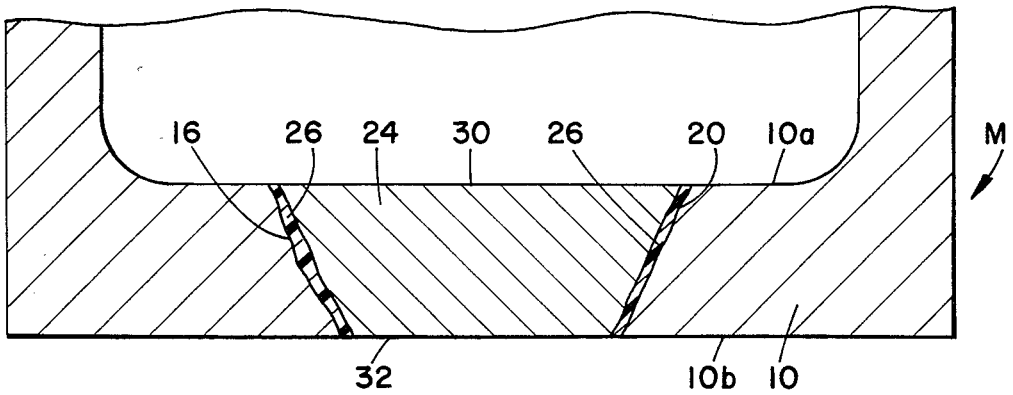

Most often, the bottom opening in a mold will be plugged following the stripping of an ingot from the mold and while the mold is still hot from the previous casting operation. In connection with the plugging of such a mold with plug 22 described above, the latter is pressed into the mold opening whereupon coating 26 is squeezed upwardly along outer peripheral surface 34 of the plug body. As will be appreciated from FIG. 3, such squeezing causes the sealing composition to flow into and fill irregularities in the mold opening wall surface, such as is shown with respect to recesses 16 and 20 of mold M. During the plug inserting process, plastic film 28 is consumed by the heat of the mold which is generally at a temperature of about 500° F., and the curing process is immediately initiated with respect to curing the sealing composition. As mentioned hereinabove, however, it will be appreciated that plug 22 can be introduced into the bottom opening of a mold which is at ambient temperature and, in such event, plastic film 28 will rupture in response to the pressing of the plug into the mold opening, whereby the sealing composition 26 will be squeezed upwardly about the outer peripheral surface of the plug as described above. Upon the pouring of molten metal into the cold ingot mold, the plastic film will disintegrate, and the molten metal will initiate curing of the sealing composition.

While it is advantageous to coat a preformed plug body with the thermosetting sealing composition and enclose the coated plug body in a plastic wrap to facilitate handling and storage, it will be appreciated that an ingot mold can be plugged and sealed in accordance with the present invention by providing a coating of the sealing material on the outer peripheral surface of the plug body and immediately pressing the coated plug body into the mold opening to squeeze the coating material between the plug body and mold opening to fill surface irregularities and thus seal the opening against leakage of molten metal thereacross.

In a preferred embodiment of the present invention, the sealing composition is comprised, by weight, of about 50% of a suitable aggregate or mixture of aggregate materials and about 50% of a thermosetting binder. The aggregate preferably has a screen size of about 80×0 and is dried to have a moisture content of no more than 2% and preferably less than 1%. As mentioned hereinbefore, the binder is preferably a water-free thermosetting resinous binder, and it is further preferred to employ a binder system comprised of equal amounts of two water-free thermosetting resinous binders having different temperatures at which polymerization of the corresponding resin commences. More particularly in this respect, the first of the two binders is a phenolic binder, and the second is a furan binder. While such resinous binders can be obtained separately and combined when making the sealing composition, they are available as a mixture of equal amounts of each from The Ashland Chemical Company of Columbus, Ohio under the latter's product designation 65-046. In the preferred composition, therefore, there would be 25% of each of the phenolic and fara binders. The phenolic binder has a polymerization temperature of about 120° F. and the furan binder has a polymerization temperature of about 300° F. Both binders have a curing temperature of about 350° F. to 400° F.

The phenolic and furan binders in combination advantageously provide for controlling curing of the sealing material so as to optimize the strength of the cured material. Furthermore, the relatively low polymerization temperature of the phenolic binder is advantageous from the standpoint of providing for curing to begin at a low temperature while the higher polymerization temperature of the furan binder, in combination with the phenolic binder, retards the quick cure characteristic of the phenolic binder. The binding system defined by these two binders provides a broad operating temperature range of from ambient to about 700° F. to 800° F. through which curing takes place, and controls the curing process so that the cured sealing material is stronger than that which could be achieved with either of the binders alone, thus optimizing sealing of the mold against leakage through the opening and retention of the preformed plug body in the mold opening. Furthermore, the broad operating temperature range for the sealing composition and the controlled curing thereof advantageously enables a coated mold plug to be placed in the plug opening of a mold which is at ambient temperature or which is still relatively hot from a preceding casting operation, and the immediate pouring of molten metal into the plug mold, whereby curing takes place during the casting process. Alternatively, the coated mold plug can be placed in the mold opening and cured in place prior to the pouring of molten metal into the mold. In the latter instance, the curing time is primarily dependent on the mold temperature.

A preferred aggregate for the sealing composition, from the standpoint of availability and economy, is a relatively inexpensive mined material known as Black Diamond which is available from a mine by the same name in Townsend, Montana. Black Diamond has a high carbon and silica content and provides a sealing composition with the preferred binder system which, upon curing, possesses desirable hardness, thermal and refractory characteristics. The approximate composition of Black Diamond as mined and dried for use as an aggregate in a sealing composition according to the present invention is by weight, about 26% to about 29% fixed carbon, about 8% volatiles, and about 62% to about 65% ash. The approximate mineral analysis of the ash, based on a given quantity of Black Diamond is about 47.5% to about 50% silica, about 8.0% to about 8.4% alumina, about 2.8% to about 3.0% iron oxide, about 1.5% to about 1.6% potassium oxide, and trace amounts of magnesium, lime, titanium oxide, sodium oxide, sulphur trioxide, potassium pentoxide, and unknowns. The material as mined has a moisture content of about 3.0% and is dried to have a moisture content of less than 1% for use in the preferred sealing composition according to the present invention.

While considerable emphasis has been placed on specific features of the preferred embodiment of the present invention herein illustrated and described, it will be appreciated that many embodiments of the present invention can be made and that many changes can be made in the embodiments disclosed herein without departing from the principles of the present invention. Accordingly, it is to be distinctly understood that the foregoing descriptive matter is to be interpreted merely as illustrative of the present invention and not as a limitation.

Having thus described the invention, it is claimed:

1. A method of making a plug for closing the bottom opening in a top pouring ingot mold comprising, providing a preformed mold plug member having top and bottom ends and an outer peripheral surface between said ends and received in said openings, coating at least a portion of said peripheral surface with a heat curable sealing composition, and completely covering said coating with a film of heat degradable plastic material.

2. The method according to claim 1, wherein said coating has a thickness of from about 0.250 inch to about 0.375 inch.

3. The method according to claim 1, wherein said plastic film is heat shrinkable, and said covering of said coating comprises enclosing said coated plug member in said plastic film and heating said enclosed coated plug member to shrink said film about said plug member and coating.

4. The method according to claim 3, wherein said heating to shrink said film is achieved by exposing said enclosed coated plug member to a temperature of about 350° F. for a period of about five seconds.

5. The method according to claim 1, wherein said sealing composition is comprised, by weight, of about 50% of an aggregate material and about 50% of thermosetting resinous binder.

6. The method according to claim 5, wherein said binder comprises Furan resin binder and a phenolic resin binder.

7. The method according to claim 6, wherein said Furan and phenolic resins are in equal amounts in said composition.

8. The method according to claim 6, wherein said coating has a thickness of from about 0.250 inch to about 0.375 inch and said plastic film is heat shrinkable, and exposing said enclosed coated plug member to a temperature of about 350° for about five seconds to shrink said plastic film.

9. The method according to claim 8, wherein said aggregate includes carbon and silica as predominent ingredients and a minor amount of alumina.

10. The method according to claim 9, wherein said Furan and phenolic resins are in equal amounts in said composition.

11. A plug for sealing the bottom opening in a top pouring mold comprising, a plug body having top and bottom ends and an outer peripheral surface between said ends and received in said opening, a coating of heat curable sealing material on said peripheral surface and covering at least a portion of said surface between said ends, and heat degradable plastic film means on said body completely covering said coating.

12. A plug according to claim 11, wherein said plastic film has a thickness of about 0.001 inch.

13. A plug according to claim 11, wherein said plastic film means conforms to the contour of said coating and adjacent surface portions of said plug body.

14. A plug according to claim 11, wherein said coating covers only a portion of said peripheral surface from said bottom end toward said top end.

15. A plug according to claim 11, wherein said sealing material is comprised of a finely ground aggregate and a thermosetting resinous binder.

16. A plug according to claim 11, wherein said coating has a thickness of from about 0.250 to about 0.375 inch.

17. A plug according to claim 16, wherein said sealing material is comprised of a finely ground aggregate and a thermosetting resinous binder.

18. A plug according to claim 17, wherein said coating covers only a portion of said peripheral surface from said bottom end toward said top end.

19. A plug according to claim 18, wherein said plastic film has a thickness of about 0.001 inch.

20. A plug according to claim 19, wherein said plastic film means conforms to the contour of said coating and adjacent surface portions of said plug body.

21. A plug according to claim 11, wherein said sealing material is comprised by weight of about 50% of a finely ground aggregate and about 50% of thermosetting resinous binder.

22. A plug according to claim 21, wherein said binder is comprised of about equal amounts of a Furan resin binder and a phenolic resin binder.

23. A plug according to claim 22, wherein said aggregate includes carbon and silica as predominent ingredients and a minor amount of alumina.

24. A plug according to claim 22, wherein said coating has a thickness of from about 0.250 inch to about 0.375 inch.

25. A plug according to claim 24, wherein said plastic film has a thickness of about 0.001 inch.

26. A plug according to claim 25, wherein said coating covers only a portion of said peripheral surface from said bottom end toward said top end.

27. A plug according to claim 26, wherein said plastic film means conforms to the contour of said coating and adjacent surface portions of said plug body.

28. A method of plugging the bottom opening in a top pouring ingot mold using a preformed mold plug member seatable in the opening, said opening and plug member having opposed peripheral surfaces when said plug member is seated in said opening, said method comprising, coating at least a portion of the peripheral surface of said plug member with a heat curable sealing composition in a flowable state, pressing said coated plug member in the bottom opening for the flowable composition to conform to the contours of said opposed peripheral surfaces, and heating said coating to cure said composition and secure said plug member in said opening, said sealing composition being comprised, by weight, of about 50% of an aggregate material and about 50% of thermosetting resinous binder.

29. The method according to claim 28, wherein said binder comprises a Furan resin binder and a phenolic resin binder.

30. The method according to claim 29, wherein said Furan and phenolic resin binders are in equal amounts in said composition.

31. The method according to claim 30, wherein said aggregate includes carbon and silica as predominent ingredients and a minor amount of alumina.

* * * * *